US006913545B2

(12) United States Patent
Jones et al.

(10) Patent No.: US 6,913,545 B2
(45) Date of Patent: Jul. 5, 2005

(54) GOLF CLUB HEAD HAVING A FACE INSERT WITH A VISUAL OUTLINE

(75) Inventors: David D. Jones, Glendale, AZ (US); Leslie J. Bryant, Peoria, AZ (US); Guillermo G. Vald'via, Phoenix, AZ (US); Roger J. Kleber, Glendale, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 10/632,580

(22) Filed: Jul. 31, 2003

(65) Prior Publication Data

US 2005/0026717 A1 Feb. 3, 2005

(51) Int. Cl.[7] ..... A63B 53/04
(52) U.S. Cl. ..... 473/342; 473/340; 473/350
(58) Field of Search ..... 473/332, 342, 473/340–341

(56) References Cited

U.S. PATENT DOCUMENTS 5,303,922 A 4/1994 Lo
5,423,535 A * 6/1995 Shaw et al. ..... 473/291
6,083,117 A 7/2000 Hsu
6,238,302 B1 * 5/2001 Helmstetter et al. ..... 473/340
6,375,583 B1 4/2002 Solheim
6,746,344 B1 * 6/2004 Long ..... 473/346
2004/0038746 A1 * 2/2004 Wahl et al. ..... 473/340
2004/0067800 A1 * 4/2004 Kawano ..... 473/340

* cited by examiner

*Primary Examiner*—Stephen Blau
(74) *Attorney, Agent, or Firm*—Darrell F. Marquette

(57) ABSTRACT

A golf club head includes a body having a front face with a cavity formed therein. The cavity is defined by a bottom wall and a side wall, and a face insert is disposed in the cavity. The face insert has a perimeter edge spaced from the cavity side wall by a continuous protrusion that extends outwardly from the perimeter edge toward the cavity side wall. The continuous protrusion creates and maintains a continuous gap between the perimeter edge of the face insert and the side wall of the cavity. The continuous gap is filled with paint having a color which contrasts with the body and the face insert to provide a visual outline of the face insert. A plurality of dome-shaped protrusions extend rearwardly from a back surface of the face insert to keep the back surface of the face insert spaced from the cavity bottom wall. Double sided adhesive tape is disposed between the back surface of the face insert and the cavity bottom wall to fix the face insert to the body.

25 Claims, 3 Drawing Sheets

GOLF CLUB HEAD HAVING A FACE INSERT WITH A VISUAL OUTLINE

BACKGROUND OF THE INVENTION

This invention relates generally to golf equipment and, in particular, to a golf club head having a face insert with a visual outline.

U.S. Pat. No. 6,375,583 to J. K. Solheim discloses a golf putter head that includes a metal body with a front face and a non-metallic face insert disposed in the front face of the body. The method of making this putter head involves forming the face insert by filling a cavity in the body front face with liquid polyurethane and then curing the liquid polyurethane by allowing it to harden at room temperature. Finally, the putter head is finished by milling the front face and the face insert. A drawback of the putter head disclosed in the Solheim patent is that the method of making it is time consuming.

SUMMARY OF THE INVENTION

The present invention provides a golf club head including a body having a front face with a cavity formed therein. The cavity is defined by a bottom wall and a side wall, and a face insert is disposed in the cavity. The face insert has a perimeter edge spaced from the cavity side wall by a continuous protrusion that extends outwardly from the perimeter edge toward the cavity side wall. The continuous protrusion creates and maintains a continuous gap between the perimeter edge of the face insert and the side wall of the cavity. The continuous gap is filled with paint preferably having a color which contrasts with the body and the face insert to provide a visual outline of the face insert. A plurality of protrusions extend rearwardly from a back surface of the face insert to keep the back surface of the face insert spaced from the cavity bottom wall. Adhesive means such as double sided adhesive tape is disposed between the back surface of the face insert and the cavity bottom wall to fix the face insert to the body.

DESCRIPTION OF THE PREFERRED EMBODIMENT

Figure 1:
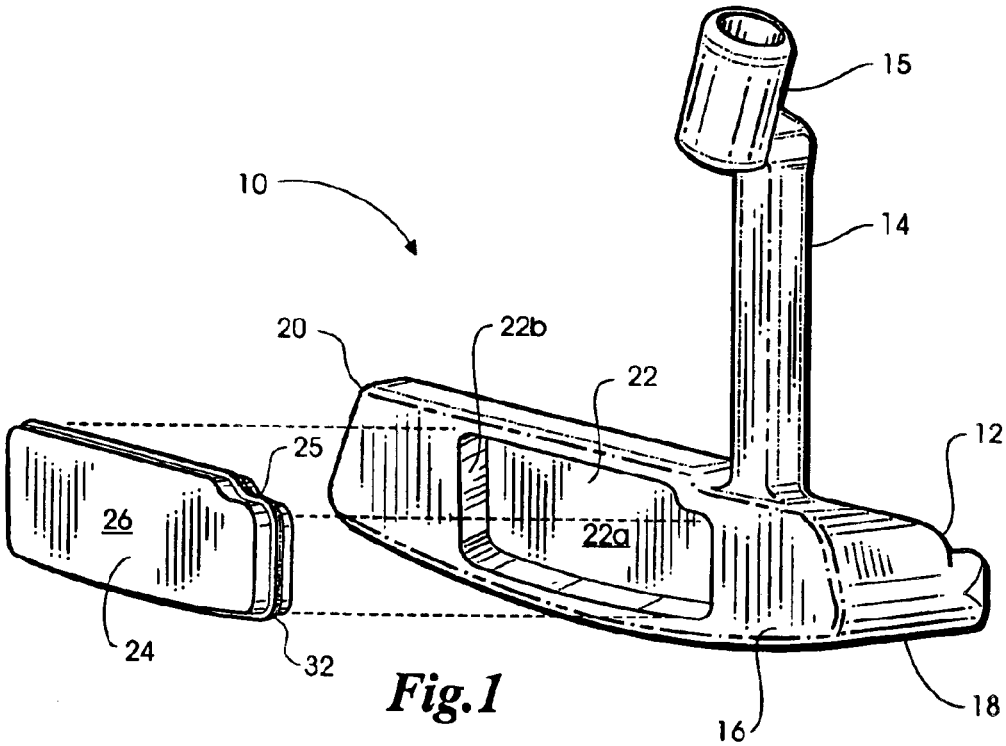
FIG. 1 is an exploded perspective view of a golf club head with a face insert according to the preferred embodiment of the present invention.

Referring to FIG. 1, a golf club head 10, preferably a golf putter head, includes a body 12 and a hosel 14 with a boss 15 for receiving one end of a shaft (not shown). The body 12 has a front face 16 arranged to impact a golf ball, a heel end 18 and a toe end 20. The front face 16 has a cavity 22 formed therein defined by a bottom wall 22*a* and a side wall 22*b*. The body 12, including the cavity 22, is formed by an investment casting process, and then the bottom and side walls 22*a*, 22*b* of the cavity 22 are shaped by a milling process to maintain precise tolerances. A face insert 24, according to the preferred embodiment of the present invention, is disposed in the cavity 22. The body 12 is preferably made of a suitable metal such as steel, and the face insert 24 is preferably made of an elastomeric material such as polyurethane.

Figure 3:
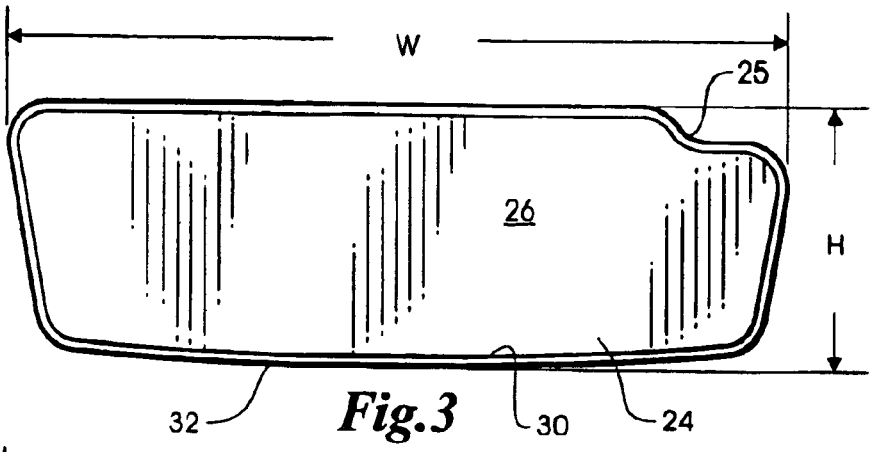
FIG. 3 is an enlarged front view of the face insert seen in FIG. 1.
Figure 4:
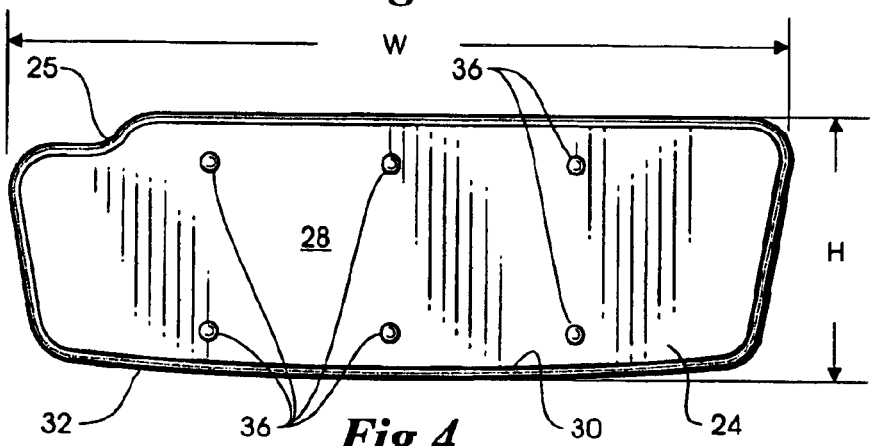
FIG. 4 is an enlarged back view of the face insert seen in FIG. 1.
Figure 5:
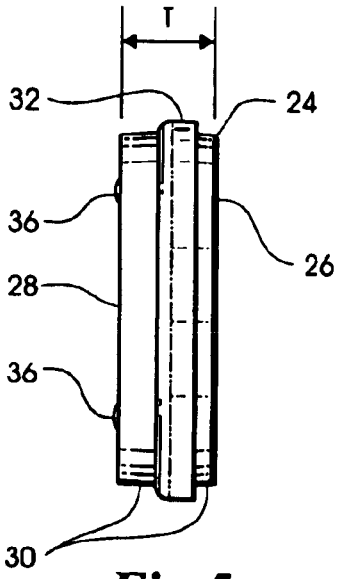
FIG. 5 is an enlarged end view of the face insert seen in FIG. 1.
Figure 6:
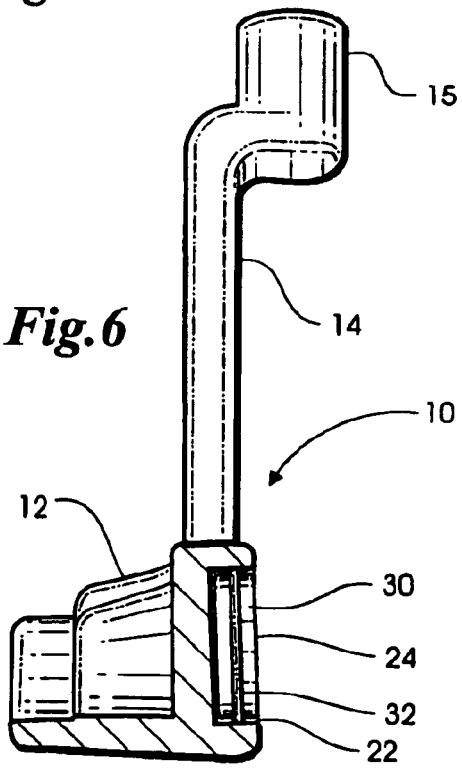
FIG. 6 is a sectional view taken along lines 6—6 in FIG. 2.

As best seen in FIGS. 3 and 4, the face insert 24 has an inverted generally trapezoidal shape with a front surface 26 and a back surface 28. The face insert 24 includes a notched-out section in an upper corner 25 to accommodate the hosel 14. In other club heads (not shown), this notched-out section in the upper corner 25 of the face insert 24 is not needed because the hosel 14 is located in a different position. The face insert 24 is formed by an injection molding process with a maximum width W of approximately 2.300 inches and a maximum height H of approximately 0.725 inches. The face insert 24 also has a thickness T of approximately 0.200 inch measured between the front surface 26 and the back surface 28 as shown in FIG. 5. The cavity 22 has a depth of approximately 0.215 inch as measured between the body front face 16 and the cavity bottom wall 22*a*.

Figure 2:
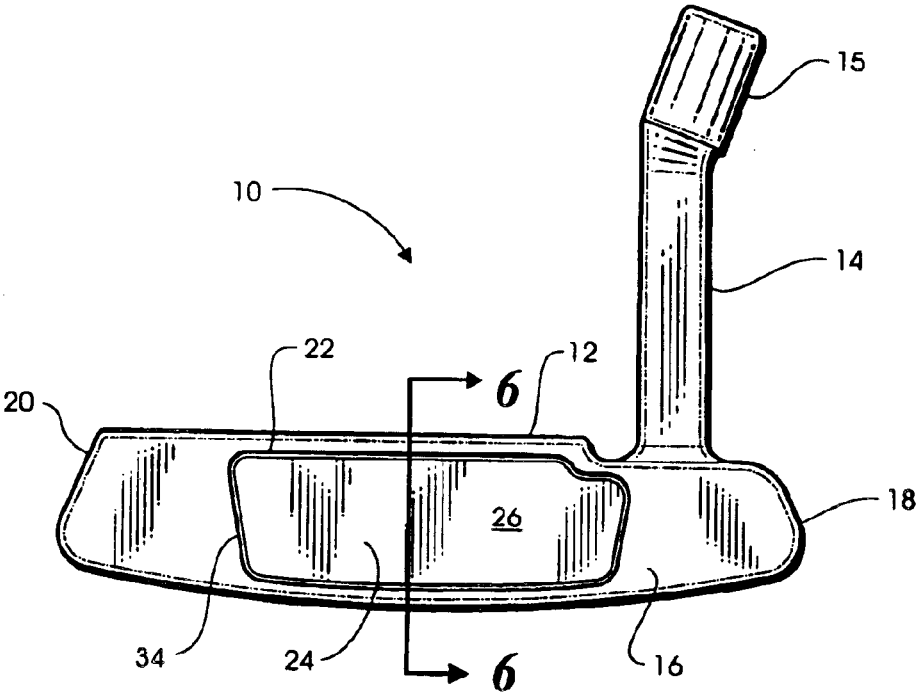
FIG. 2 is a front elevational view of the golf club head shown in FIG. 1.
Figure 7:
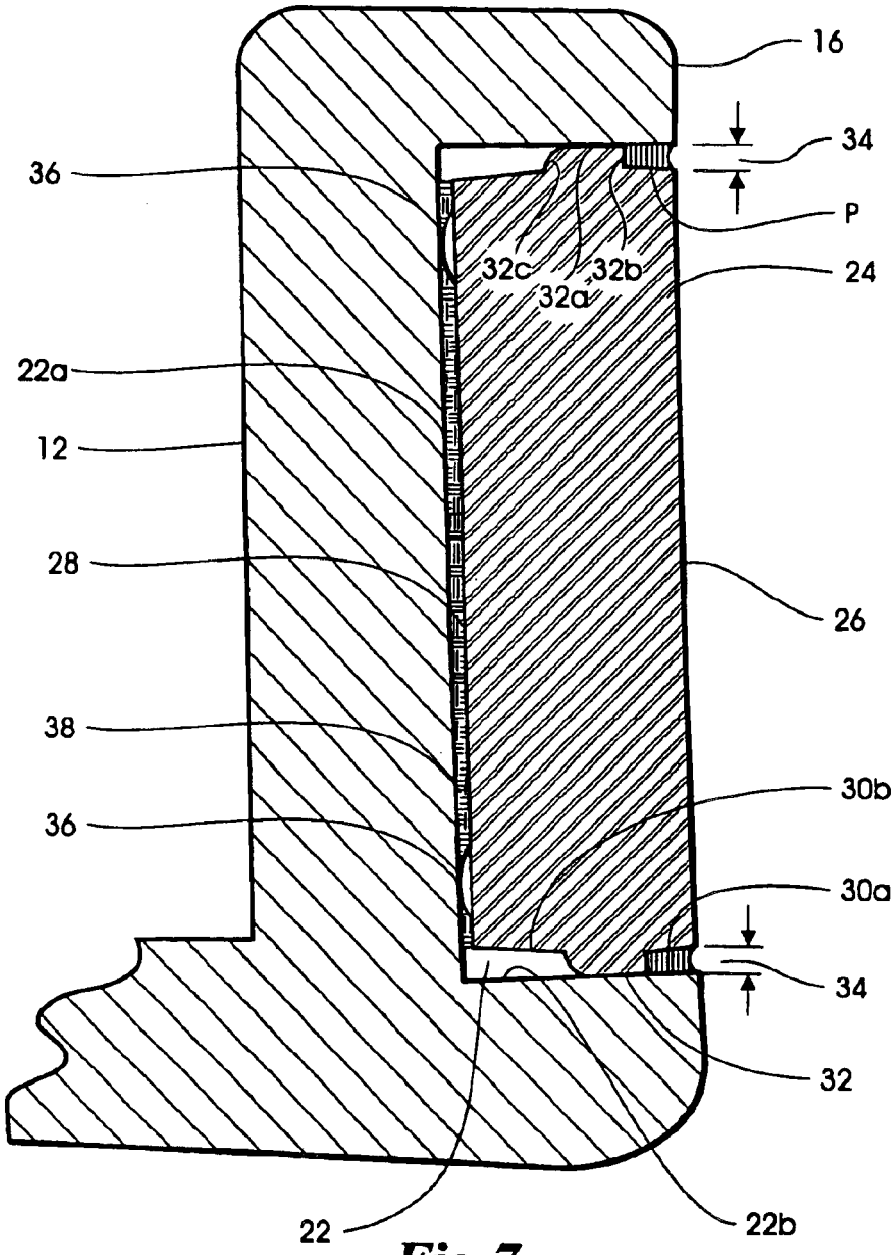
FIG. 7 is an enlarged view of a portion of the golf club head shown in FIG. 6.

Extending between its front and back surfaces 26 and 28, the face insert 24 has a perimeter edge 30 that is spaced from the side wall 22*b* of the cavity 22 by a continuous protrusion 32 that extends outwardly approximately 0.025 inch from the perimeter edge 30 and separates the perimeter edge 30 into a forward portion 30*a* and a rearward portion 30*b* as best shown in FIG. 7. The continuous protrusion 32 has an outer surface 32*a* located between a square corner 32*b* and a rounded corner 32*c*. The continuous protrusion 32 creates and maintains a continuous gap 34 (FIGS. 2 and 7) that is approximately 0.025 inch wide measured between the forward portion 30*a* of the face insert perimeter edge 30 and the side wall 22*b* of the cavity 22. Also, the continuous gap 34 is approximately 0.025 inch deep. Since the outer surface 32*a* of the continuous protrusion 32 contacts the cavity side wall 22*b* when the face insert 24 is installed in the cavity 24, the continuous protrusion 32 properly positions (i.e. "centers") the face insert 24 with respect to the cavity 22.

The face insert 24 preferably has a plurality of substantially dome-shaped protrusions 36 that extend rearwardly approximately 0.005 inch from the back surface 28. When the face insert 24 is disposed in the cavity 22, these protrusions 36 keep its back surface 28 spaced from the cavity bottom wall 22*a*. The face insert 24 is fixed to the body 12 by using adhesive means such as double sided adhesive tape 38 which is disposed between the back surface 28 of the face insert 24 and the bottom wall 22*b* of the cavity 22. The adhesive tape 38 is applied to the back surface 28 before the face insert 24 is installed in the body 12. The adhesive tape 38 is approximately 0.015 inch thick and is cut to a size and shape that matches the back surface 28 of the face insert 24. A press is then used to seat the face insert 24 in the cavity 22 thereby causing the protrusions 36 to bite into the adhesive tape 38 until the front surface 26 of the face insert 24 is coplanar with the front face 16 of the body 12. Finally, the gap 34 is filled with paint P that is preferably a color which contrasts with the body 12 and the face insert 24 to provide a visual outline of the face insert 24.

In an alternative embodiment not shown, the continuous protrusion 32 will be replaced by an O-ring that fits into a continuous groove formed in the perimeter edge 30 of the face insert 24. The continuous groove has a depth that allows a predetermined amount of the O-ring to protrude outwardly from the perimeter edge 30 of the face insert 24 in order to create and maintain the continuous gap 34.

What is claimed is:

1. A golf club head comprising:

a body having a front face with a cavity formed therein, said cavity being defined by a bottom wall and a side wall;

a face insert disposed in said cavity, said face insert having a perimeter edge spaced from the side wall of said cavity;

a continuous protrusion extending outwardly from the perimeter edge of said face insert toward the side wall of said cavity for creating and maintaining a continuous gap between the perimeter edge of said face insert and the side wall of said cavity;

said face insert having a front surface and a back surface, said continuous protrusion having an outer surface which contacts said cavity side wall; and a plurality of protrusions extending rearwardly from the back surface of said face insert for keeping the back surface of said face insert spaced from the bottom wall of said cavity.

2. The golf club head of claim 1, wherein said face insert has a thickness of approximately 0.200 inch measured between the front and back surfaces thereof.

3. The golf club head of claim 2, wherein said face insert has a maximum width of approximately 2.300 inches and a maximum height of approximately of 0.725 inches.

4. The golf club head of claim 1, wherein said continuous protrusion extends outwardly approximately 0.025 inch from the perimeter edge of said face insert and wherein said continuous gap is approximately 0.025 inch wide.

5. The golf club head of claim 1, wherein each of said plurality of protrusions extend approximately 0.005 inch from the back surface of said face insert.

6. The golf club head of claim 1, wherein said body is made of metal and said face insert is made of an elastomeric material.

7. The golf club head of claim 1, wherein said body is made of steel and said face insert is made of polyurethane.

8. The golf club head of claim 1, wherein said face insert has an inverted generally trapezoidal shape.

9. The golf club head of claim 1, wherein said continuous gap is filled with paint having a color which contrasts with said body and said face insert to provide a visual outline of said face insert.

10. A golf club head comprising:

a body having a front face with a cavity formed therein, said cavity being defined by a bottom wall and a side wall;

a face insert disposed in said cavity, said face insert having a perimeter edge spaced from the side wall of said cavity;

a continuous protrusion extending outwardly from the perimeter edge of said face insert toward the side wall of said cavity for creating and maintaining a continuous gap between the perimeter edge of said face insert and the side wall of said cavity;

said face insert having a front surface and a back surface, said continuous protrusion having an outer surface which contacts said cavity side wall; and adhesive means disposed between the back surface of said face insert and the bottom wall of said cavity for fixing said face insert to said body.

11. The golf club head of claim 10, wherein said adhesive means comprises double sided adhesive tape.

12. In a golf club head including a body having a front face with a cavity formed therein, said cavity being defined by a bottom wall and a side wall, an improvement comprising:

a face insert disposed in said cavity, said face insert having a perimeter edge spaced from the side wall of said cavity by a continuous protrusion that extends outwardly from the perimeter edge of said face insert toward the side wall of said cavity, said continuous protrusion creating and maintaining a continuous gap between the perimeter edge of said face insert and the side wall of said cavity;

said face insert having a front surface and a back surface, said continuous protrusion having an outer surface which contacts said cavity side wall; and a plurality of protrusions extending rearwardly from the back surface of said face insert for keeping the back surface of said face insert spaced from the bottom wall of said cavity.

13. The improvement of claim 12, wherein said face insert has a thickness of approximately 0.200 inch measured between the front and back surfaces thereof.

14. The improvement of claim 12, wherein said continuous protrusion extends outwardly approximately 0.025 inch from the perimeter edge of said face insert and wherein said continuous gap is approximately 0.025 inch wide.

15. The improvement of claim 12, wherein each of said plurality of protrusions extend approximately 0.005 inch from the back surface of said face insert.

16. The improvement of claim 12, wherein said continuous gap is filled with paint having a color which contrasts with said body and said face insert to provide a visual outline of said face insert.

17. A golf putter head comprising:

a body having a front face with a cavity formed therein, said cavity being defined by a bottom wall and a side wail;

a face insert disposed in said cavity, said face insert having a front surface, a back surface and a perimeter edge spaced from the side wall of said cavity;

a continuous protrusion extending outwardly from the perimeter edge of said face insert toward the side wall of said cavity for creating and maintaining a continuous gap between the perimeter edge of said face insert and the side wall of said cavity;

a plurality of protrusions extending rearwardly from the back surface of said face insert for keeping the back surface of said face insert spaced from the bottom wall of said cavity; and adhesive means disposed between the back surface of said face insert and the bottom wall of said cavity for fixing said face insert to said body.

18. The golf putter head of claim 17, wherein said adhesive means comprises double sided adhesive tape.

19. The golf putter head of claim 17, wherein said continuous protrusion extends outwardly approximately 0.025 inch from the perimeter edge of said face insert and has an outer surface which contacts said cavity side wall.

20. The golf putter head of claim 19, wherein said continuous gap is approximately 0.025 inch wide.

21. The golf putter head of claim 20, wherein: said cavity has a depth of approximately 0.215 inch measured between the front face of said body and said cavity bottom wall;

said face insert has a thickness of approximately 0.200 inch measured between the front and back surfaces thereof;

each of said plurality of protrusions extend approximately 0.005 inch from the back surface of said face insert; and said adhesive tape has a thickness of approximately 0.015 inch.

22. The golf putter head of claim 17, wherein said continuous gap is filled with paint having a color which contrasts with said body and said face insert thereby providing a visual outline of said face insert.

23. A method of making a golf club head comprising:

providing a body having a front face with a cavity formed therein, said cavity being defined by a bottom wall and a side wall;

installing a face insert in said cavity, said face insert having a perimeter edge spaced from the side wall of said cavity by a continuous protrusion that extends outwardly from the perimeter edge of said face insert toward the side wall of said cavity;

utilizing said continuous protrusion to create and maintain a continuous gap between the perimeter edge of said face insert and the side wall of said cavity; and fixing said face insert to said body by applying adhesive means to a back surface of said face insert before it is installed in said cavity.

24. The method of claim 23, further comprising:

filling said continuous gap with paint having a color which contrasts with said body and said face insert to provide a visual outline of said face insert.

25. The method of claim 23, further comprising:

pressing said face insert into said cavity so that said adhesive means is disposed between the back surface of said face insert and the bottom wail of said cavity.

* * * * *